US009802738B2

(12) United States Patent
Choi

(10) Patent No.: US 9,802,738 B2
(45) Date of Patent: Oct. 31, 2017

(54) STOPPER AND CONTAINER HAVING THE SAME

(71) Applicant: CJ Cheiljedang Corporation, Seoul (KR)

(72) Inventor: Min Seok Choi, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 0 days.

(21) Appl. No.: 14/902,913

(22) PCT Filed: Jul. 10, 2014

(86) PCT No.: PCT/KR2014/006219
§ 371 (c)(1),
(2) Date: Jan. 5, 2016

(87) PCT Pub. No.: WO2015/008972
PCT Pub. Date: Jan. 22, 2015

(65) Prior Publication Data

US 2016/0145013 A1 May 26, 2016

(30) Foreign Application Priority Data

Jul. 18, 2013 (KR) ..... 20-2013-0005984

(51) Int. Cl.
*B65D 47/08* (2006.01)

(52) U.S. Cl.
CPC ..... *B65D 47/0842* (2013.01)

(58) Field of Classification Search
CPC ..... B65D 47/0804; B65D 47/0842
USPC ..... 222/212, 569, 570, 562, 563, 546, 556, 222/209
See application file for complete search history.

(56) References Cited

U.S. PATENT DOCUMENTS 4,387,819 A * 6/1983 Corsette ..... B65D 47/128 215/273
8,292,103 B2 * 10/2012 Weist ..... B65D 47/0842 215/252
2012/0067922 A1 * 3/2012 Benoit-Gonin .... B65D 47/0857 222/153.06

FOREIGN PATENT DOCUMENTS

| | | |
|---|---|---|
| CN | 1446746 A | 10/2003 |
| JP | 2000-338256 | 5/2002 |
| JP | 2002-145293 A | 5/2002 |
| JP | 2013-116767 A | 6/2013 |
| JP | 2013-116767 A | 6/2013 |

(Continued)

OTHER PUBLICATIONS

JP Patent Application No. 2016-525287, Office Action, dated Dec. 8, 2016, 3 pages.

(Continued)

*Primary Examiner* — Donnell Long
(74) *Attorney, Agent, or Firm* — Swanson & Bratschun, L.L.C.

(57) ABSTRACT

Disclosed is a stopper and a container having the same including a stopper body including an upper part having a discharge hole, and a side part, having at least a dual structure, including an inner part and an external part which are spaced apart from each other and a coupling portion coupling the inner part and the external part at a top of the inner part and the external part, wherein the side part may include a first protrusion at the top of the inner part, a first groove at the coupling portion and a second protrusion between the first groove and the external part.

12 Claims, 4 Drawing Sheets

(56) References Cited

FOREIGN PATENT DOCUMENTS

| | | | |
|---|---|---|---|
| KR | 20-1997-0023411 | U | 6/1997 |
| KR | 10-2011-0051536 | A | 5/2011 |
| KR | 10-1068559 | B1 | 9/2011 |

OTHER PUBLICATIONS

International Search Report for International Application No. PCT/KR2014/006219 dated Jan. 22, 2015.
CN Patent Application No. 201480039871.2 NonFinal Office Action dated Aug. 29, 2016, 6 pages.
CN Patent Application No. 201480039871-2, 2$^{nd}$ Office Action, dated Jul. 3, 2017, 7 pages.

* cited by examiner

[Fig. 1]
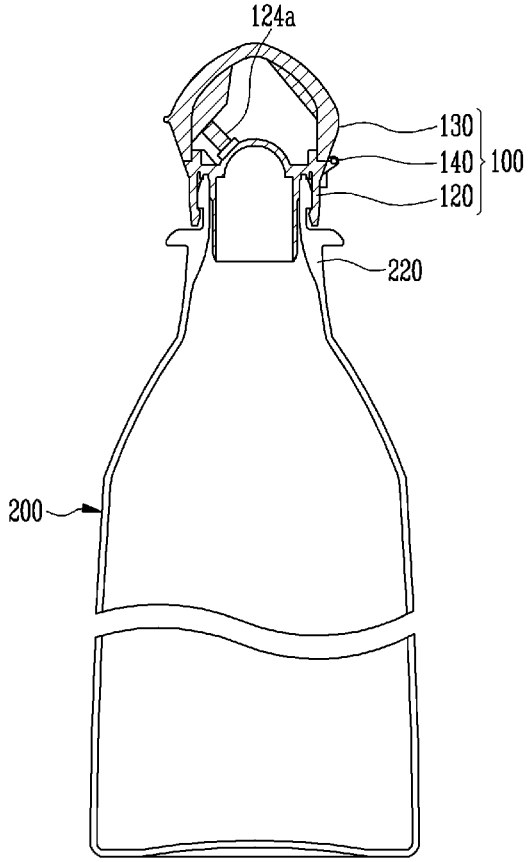

[Fig. 2]
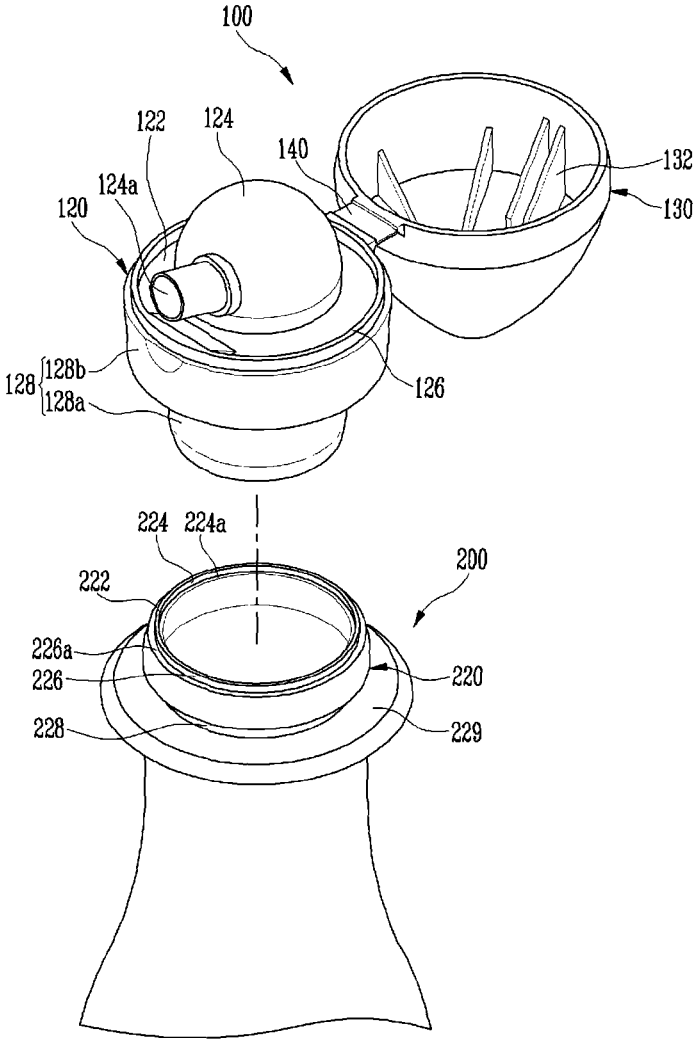
[Fig. 3]
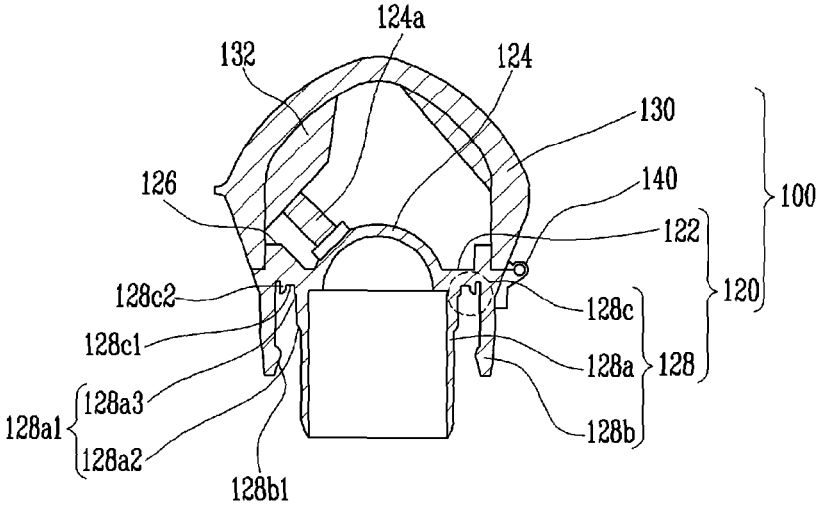

[Fig. 4]
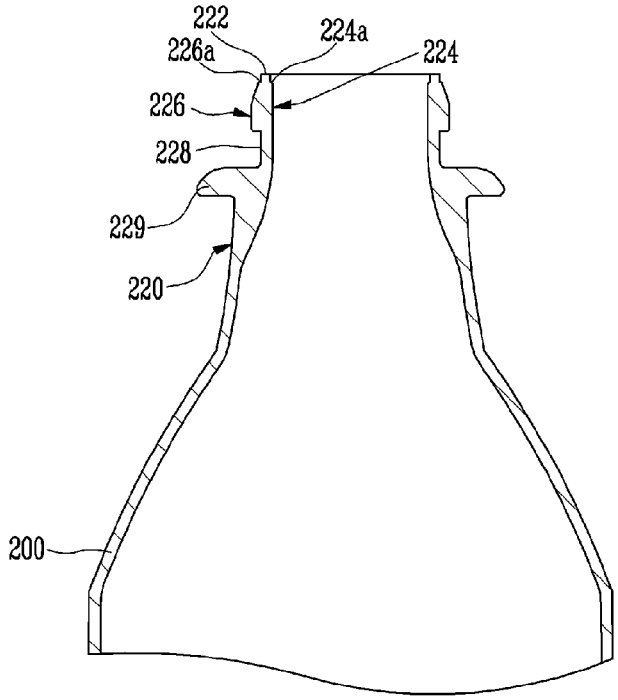
[Fig. 5a]
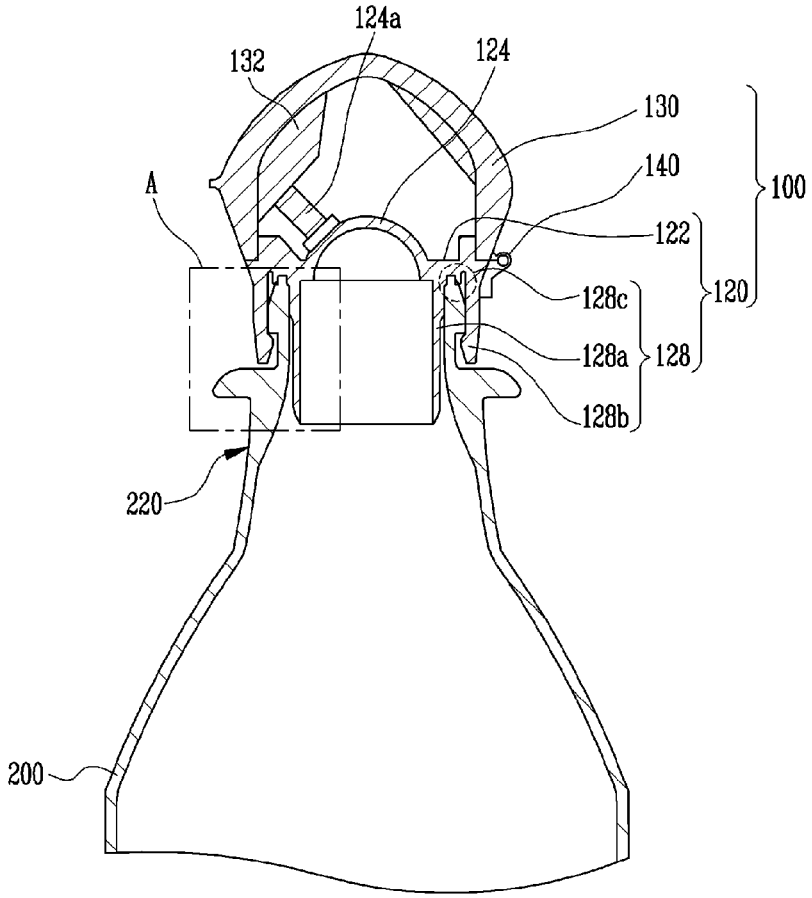

[Fig. 5b]
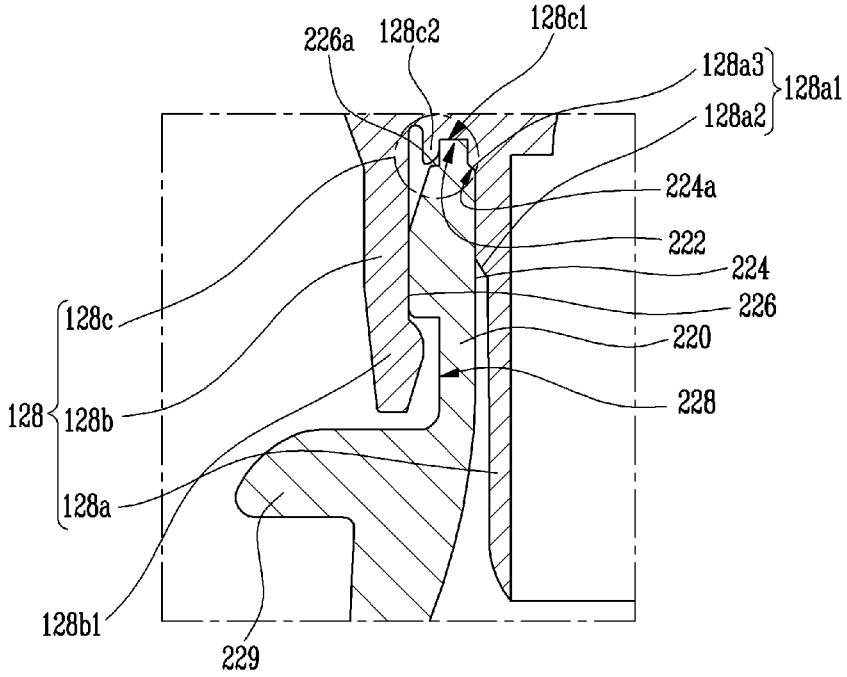

STOPPER AND CONTAINER HAVING THE SAME

RELATED APPLICATIONS

This application is a 35 U.S.C. §371 national phase application of PCT/KR2014/006219 (WO 2015/008972), filed on Jul. 10, 2014, entitled "Stopper and Container Having the Same", which application claims the benefit of Korean Application No. 20-2013-0005984, filed Jul. 18, 2013, which is incorporated herein by reference in its entirety for all purposes as if fully set forth herein.

TECHNICAL FIELD

Embodiments relate to a stopper and a container having the same.

BACKGROUND ART

Generally, the opening of a container which stores liquid substance such as cooking oil, soy sauce, etc. has a stopper.

The stopper includes a stopper body which is coupled to a container body where the substance is stored and a cap which is coupled to the stopper body and which is designed to open and shut the container.

The stopper body has a discharge hole. The discharge hole allows the substance which is stored in the container to be discharged. The liquid substance can be discharged to outside by tilting the container or pressing down on the container body, etc.

When a user intentionally discharges the liquid substance out, however, the substance may leak through between the container body and the stopper, causing inconvenience to the user.

DISCLOSURE OF INVENTION

Technical Problem

The present invention is related to a stopper and a container having the same capable of effectively preventing leakage.

Other purposes of this present invention can be conceived by a person of ordinary skill in the art through below embodiments.

Solution to Problem

In an embodiment, a stopper may include a stopper body including an upper part having a discharge hole, and a side part, having at least a dual structure, including an inner part and an external part which are spaced apart from each other and a coupling portion coupling the inner part and the external part at a top of the inner part and the external part, wherein the side part may include a first protrusion at the top of the inner part, a first groove at the coupling portion and a second protrusion between the first groove and the external part.

In an embodiment, the first protrusion may protrude, from a top of a side surface of the inner part facing the external part, in a direction towards the external part.

In an embodiment, the first protrusion may have at least a dual structure including a first step portion and a second step portion.

In an embodiment, the second protrusion may protrude, from a surface of the coupling portion, in a direction towards a bottom.

In an embodiment, the first and second protrusions may be coupled to each other via the first groove.

In an embodiment, the external part may include a third protrusion protruding, from a bottom of a side surface facing the inner part, in a direction towards the inner part.

In an embodiment, a container may include a container body having an inlet at an upper part which is open and a stopper configured to be coupled to the inlet, wherein the stopper may include a stopper body including an upper part having a discharge hole and a side part having at least a dual structure including an inner part and an external part such that the inlet may be inserted therebetween, wherein the side part may include a first protrusion protruding from a top of the inner part so as to be coupled to a top of an inner surface of the inlet, a first groove between the inner part and the external part so as to be coupled to a top surface of the inlet and a second protrusion between the first groove and the external part so as to be coupled to a side surface of the top of the inlet at the first groove.

In an embodiment, the inlet may include a first stepwise part at the top of the inner surface.

In an embodiment, the first protrusion may include a stepped structure corresponding to the first stepwise part.

In an embodiment, the inlet may include a second stepwise part at a top of an external surface.

In an embodiment, the second protrusion may be coupled to the inlet at an upper part of the second stepwise part.

In an embodiment, the external part of the stopper body may include a third protrusion protruding from a bottom of the external part so as to be coupled to a bottom of an external surface of the inlet.

In an embodiment, the inlet may include a groove portion at the bottom of the external surface to receive the third protrusion.

In an embodiment, the inlet may further include a third stepwise part protruding from a lower part of a region where the external part of the stopper is located.

Advantageous Effects of Invention

The stopper and the container may have the at least the dual coupling structure, thereby reducing assembling errors.

Also, when the stopper and the container body are coupled, they may have multiple leakage preventing structure, thereby effectively preventing leakage.

BRIEF DESCRIPTION OF DRAWINGS

FIG. 1 is a cross-sectional diagram illustrating a stopper and a container having the same according to an embodiment.

FIG. 2 is an exploded perspective view illustrating main parts of the stopper and the container having the same in FIG. 1.

FIG. 3 is a cross-sectional view illustrating the stopper in FIG. 2.

FIG. 4 is a cross-sectional view illustrating the container in FIG. 2.

FIG. 5A is a combined cross-sectional view of the stopper and the container having the same in FIG. 2.

FIG. 5B is an enlarged view of a region A in FIG. 5A.

MODE FOR THE INVENTION

Example embodiments will now be described more fully hereinafter with reference to the accompanying drawings;

however, they may be embodied in different forms and should not be construed as limited to the embodiments set forth herein. Rather, these embodiments are provided so that this disclosure will be thorough and complete, and will fully convey the scope of the example embodiments to those skilled in the art. As used herein, the term and/or includes any and all combinations of one or more of the associated listed items.

In the drawing figures, dimensions may be exaggerated for clarity of illustration. It will be understood that when an element is referred to as being between two elements, it can be the only element between the two elements, or one or more intervening elements may also be present. Like reference numerals refer to like elements throughout.

FIG. 1 is a cross-sectional diagram illustrating a stopper and a container having the same according to an embodiment.

Referring to FIG. 1, the container may include a container body 200 having an inlet 220 which is open at an upper part of the container body 200 and a stopper 100 configured to be coupled to the inlet 220 at the upper part of the container body 200. The container may be designed so as to store and discharge liquid substance, for example.

The stopper 100 may include a stopper body 120 configured to be coupled to the inlet 220, a cap 130 configured to be coupled so as to be opened and closed at an upper part of the stopper body 120 and a hinge portion 140 coupling the stopper body 120 and the cap 130, wherein a discharge hole 124*a* discharging the substance may be provided at the upper part of the stopper body 120.

A user may easily discharge the liquid substance stored in the container by tilting the container, pressing the container body 200, etc.

However, when the user intentionally discharges or stores the substance by tiling the container or applying a force on the container body 200, the liquid substance may easily leak through between the container body 200 and the stopper 100, causing inconvenience to the user.

FIGS. 2 to 5B illustrate a stopper 100 and a container having the same capable of effectively preventing leakage.

FIG. 2 is an exploded perspective view illustrating main parts of the stopper and the container having the same in FIG. 1. FIG. 3 is a cross-sectional view illustrating the stopper in FIG. 2. FIG. 4 is a cross-sectional view illustrating the container in FIG. 2.

Referring to FIGS. 2 to 4, the stopper 100 may be configured to be coupled to the container body 200 at the inlet 220 at the top of the container body 200.

The stopper 100 may include the stopper body 120 coupled to the inlet 220 and having the discharge hole 124*a*, the cap 130 configured to be coupled so as to be opened and closed at the upper part of the stopper body 120 and the hinge portion 140 coupling the stopper body 120 and the cap 130. A press portion 132 surrounding the discharge hole 124*a* when the cap 130 is closed may be provided inside the cap 130.

The stopper body 120 may include the upper part 122 having the discharge hole 124*a* and a side part 128 having the at least the dual structure such that the inlet 220 may be inserted from inner and outer sides of the inlet 220 at the top of the container body 200.

The upper part 122 of the stopper body 120 may include a body 124 having a bulged shape, the discharge hole 124*a* configured to be coupled to the body 124 and a catching ledge 126 provided at an edge to prevent the substance from flowing to the outside.

The side part 128 of the stopper body 120 may have the at least the dual structure including an inner part 128*a* and an external part 128*b*, spaced apart from each other, such that the inlet 220 may be inserted therebetween. The side part 128 may further include a coupling portion 128*c* coupling the inner part 128*a* and the external part 128*b* at the top of the inner part 128*a* and the external part 128*b*. For example, the inner part 128*a* and the external part 128 may be coupled via the coupling portion 128*c* as one body.

The side part 128 of the stopper body 120 may have a structure capable of at least double-preventing leakage in a state in which the side part 128 and the inlet 220 are coupled.

The side part 128 of the stopper body 120 may include a first protrusion 128*a*1 provided at the top of the inner part 128*a*, a first groove 128*c*1 at the coupling portion 128*c* and a second protrusion 128*c*2 at the coupling portion 128*c* so as to be provided between the first groove 128*c*1 and the external part 128*b*. That is, the first protrusion 128*a*1 and the second protrusion 128*c*2 may be coupled via the first groove 128*c*1. In addition, the side part 128 of the stopper body 120 may further include a third protrusion 128*b*1 at a bottom of a side surface of the external part 128*b*.

The first protrusion 128*a*1 may protrude, from a top of a side surface of the inner part 128*a* facing the external part 128*b*, in a direction towards the external part 128*b*. The first protrusion 128*a*1 may be coupled to a top of an inner surface 224 of the inlet 220, pressing the inlet 220. As a result, the stopper 100 and the container body 200 may be stably coupled and at the same time prevent the substance from flowing out through the stopper 100 and the container body 200.

The first protrusion 128*a*1 may have at least a dual stepped structure including a first step portion 128*a*2 and a second step portion 128*a*3. A first stepwise part 224*a* which corresponds to the stepped structure of the first protrusion 128*a*1 may be provided in the inner surface 224 of the inlet 220. That is, the first protrusion 128*a*1 and the first stepwise part 224*a* which have corresponding shapes may be provided at the top of the inner part 128*a* of the stopper body 120 and the top of the inner surface 224 of the inlet 220 which may be coupled to each other.

The first protrusion 128*a*1 may have the at least the dual stepped structure. The first stepwise part 224*a* corresponding to a groove between the first step portion 128*a*2 and the second step portion 128*a*3 making up the stepped structure may be provided at the top of the inner surface 224 of the inlet 220 which may be coupled to the first protrusion 128*a*1. The stopper 100 may be stably placed in a secured manner to the container body 200 over two stages in a process of coupling the stopper 100 and the container body 200. As a result, the assembling errors for the stopper 100 may be minimized at the time of manufacture.

The first groove 128*c*1 may be coupled to a top surface 222 of the inlet 220. The first groove 128*c*1 may be formed to have a width corresponding to a width of the top surface 222 of the inlet 220, that is, the width in which the top surface 222 of the inlet 220 may be inserted. Accordingly, the top surface 222 of the inlet 220 may be firmly placed in the first groove 128*c*1 in a state in which the stopper 100 and the container body 200 are coupled to each other.

The second protrusion 128*c*2 may protrude, from a surface of the coupling portion 128*c* between the first groove 128*c*1 and the external part 128*b*, in a direction towards a bottom. The second protrusion 128*c*2 may reinforce the leakage preventing structure to prevent leakage between the stopper body 120 and the inlet 220 in a more assured manner, along with stably fixing an external surface at the top of the inlet 220 firmly placed at the first groove 128*c*1.

A second stepwise part 226*a* may be provided at the top of the external surface 226 of the inlet 220 to be provided at a lower part of the second protrusion 128*c*2, thereby reinforcing a coupling structure of the stopper 100 and the container body 200.

The third protrusion 128*b*1 may be provided to stably couple the stopper 100 and the container body 200. The third protrusion 128*b*1 may protrude from the bottom of the external part 128*b* of the stopper body 120 to be coupled to the bottom of the external surface 226 of the inlet 220. A groove portion 228 for receiving the third protrusion 128*b*1 may be provided at the bottom of the external surface 226 of the inlet 220.

The inlet 220 may further include a third stepwise part 229 protruding from a point where coupling between the external part 128*b* of the stopper body 120 and the inlet 220 is being completed when the stopper 100 and the container body 200 are coupled, that is, from a bottom of a region where the external part 128*b* of the stopper body 120 is provided.

The stopper 100 having the aforementioned structure and the container body 200 which is coupled to the stopper 100 may have at least a dual interlocking structure. Accordingly, assembling errors can be minimized.

When the stopper body 120 and the inlet 220 of the container body 200 are coupled to each other, at least a dual, and especially as in an embodiment, a triple leakage-preventing structure may effectively prevent the liquid substance, which is stored inside the container or which is being discharged from the container, from being leaking unintentionally.

The structure in which the stopper 100 and the container body 200 are coupled to each other will be described in reference to FIGS. 5A to 5B.

FIG. 5A is a combined cross-sectional view of the stopper and the container having the same in FIG. 2. FIG. 5B is an enlarged view of a region A in FIG. 5A. For convenience, details regarding each component described in reference to FIGS. 2 to 4 will be omitted when describing FIGS. 5A to 5B while focusing on the coupling structure of the stopper and the container body.

Referring to FIGS. 5A to 5B, the stopper 100 may be coupled to the container body 200 such that the top of the inlet 220 may be inserted between the inner part 128*a* and the external part 128*b* of the stopper body 120.

In a state in which the stopper 100 and the container body 200 are coupled to each other, the first protrusion 128*a*1 of the stopper 100 may be coupled to the top of the inner surface 224 of the inlet 220, the first groove 128*c*1 may be coupled to the top surface 222 and the second protrusion 128*c*2 may be coupled to the side surface of the top of the inlet 220 at the first groove 128*c*1. The third protrusion 128*b*1 of the stopper 100 may be coupled to the groove portion 228 at the bottom of the external surface 226 of the inlet 220.

The inlet 220 may include the first stepwise part 224*a* at the top of the inner surface 224. The first protrusion 128*a*1 may have at least a dual stepped structure corresponding to the first stepwise part 224*a*. The first protrusion 128*a*1 may cause the stopper 100 and the container body 200 to be stably coupled to each other while applying pressure to the inner surface of the inlet 220.

The inlet 220 may include the second stepwise part 226*a* at the top of the external surface 226. The second protrusion 128*c*2 may be coupled to the inlet 220 at the top region of the second stepwise part 226*a*. That is, the second protrusion 128*c*2 may be firmly placed at the upper part of the second stepwise part 226*a*.

The stopper 100 and the container body 200 may have the at least the dual interlocking structure at the top of the inlet 220. When the stopper 100 and the container body 200 are being assembled, the stopper 100 may be firstly placed at the top of the inlet 220 and then at the first stepwise part 224*a* at the top of the inner surface 224 of the inlet 220. Assembling errors may thus be minimized.

The stopper 100 and the container body 200 which are coupled to each other may have at least dual, and especially as in this embodiment, triple leakage-preventing structure. Primarily, leakage may be prevented as the first protrusion 128*a*1 of the stopper 100 is closely coupled to the inner surface 224 of the inlet 220 of the container body 200. Secondarily, leakage may be also prevented as the top surface 222 of the inlet 220 is inserted so as to be closely coupled to the first groove 128*c*1 of the stopper 100. Thirdly, leakage may be prevented as the second protrusion 128*c*2 of the stopper 100 is closely coupled to the top of the external surface 226 of the inlet 220.

As a result, even if the triple leakage preventing structure loses some of its functions due to a scratch, etc. on the stopper body 120 or the inlet 220, leakage may be avoided due to the remaining leakage preventing structure which effectively prevents unintentional leakage.

As described above, the stopper and the container having the same may effectively prevent leakage.

The stopper and the container may have the at least the dual coupling structure, thereby reducing assembling errors.

Also, when the stopper and the container body are coupled, they may have multiple leakage preventing structure, thereby effectively preventing leakage.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

The invention claimed is:

1. A stopper, comprising:

a stopper body comprising an upper part having a discharge hole and a side part having at least a dual structure including an inner part and an external part and a coupling portion coupling the inner part and the external part at a top of the inner part and the external part, wherein the inner part and the external part are spaced from each other;

wherein the side part comprises a first protrusion at the top of the inner part, a first groove at the coupling portion and a second protrusion between the first groove and the external part;

wherein the first protrusion protrudes in a direction towards the external part from a top of a side surface facing the external part; and wherein the first protrusion has at least a dual structure including a first step portion and a second step portion.

2. The stopper of claim 1, wherein the second protrusion protrudes in a direction towards a bottom from a surface of the coupling portion.

3. The stopper of claim 1, wherein the first and second protrusions are coupled to each other via the first groove.

4. The stopper of claim 1, wherein the external part comprises a third protrusion protruding in a direction towards the inner part from a bottom of a side surface facing the inner part.

5. A container comprising:

a container body having an inlet at an upper part which is open; and a stopper configured to be coupled to the inlet, wherein the stopper includes an upper part having a discharge hole and a side part having at least a dual structure including an inner part and an external part such that the inlet is inserted therebetween, wherein the side part includes a first protrusion protruding from a top of the inner part so as to be coupled to a top of an inner surface of the inlet, a first groove between the inner part and the external part so as to be coupled to a top surface of the inlet and a second protrusion between the first groove and the external part so as to be coupled to a side surface of a top of the inlet at the first groove.

6. The container of claim 5, wherein the inlet includes a first stepwise part at the top of the inner surface.

7. The container of claim 6, wherein the first protrusion has a stepped structure corresponding to the first stepwise part.

8. The container of claim 5, wherein the inlet includes a second stepwise part at a top of an external surface.

9. The container of claim 8, wherein the second protrusion is coupled to the inlet at an upper part of the second stepwise part.

10. The container of claim 5, wherein the external part of the stopper body includes a third protrusion protruding from a bottom of the external part so as to be coupled to a bottom of an external surface of the inlet.

11. The container of claim 10, wherein the inlet includes a groove portion at the bottom of the external surface to receive the third protrusion.

12. The container of claim 5, wherein the inlet further includes a third stepwise part protruding from a lower part of a region where the external part of the stopper is located.

* * * * *